US010399811B2

(12) United States Patent
Sundermann et al.

(10) Patent No.: US 10,399,811 B2
(45) Date of Patent: Sep. 3, 2019

(54) SUCTION NOZZLE FOR A SUCTION DEVICE

(71) Applicant: Windmöller & Hölscher KG, Lengerich (DE)

(72) Inventors: Fabian Sundermann, Osnabrück (DE); Frank Hoffmann, Greven (DE)

(73) Assignee: Windmöller & Hölscher KG, Lengerich (DE)

( * ) Notice: Subject to any disclaimer, the term of this patent is extended or adjusted under 35 U.S.C. 154(b) by 239 days.

(21) Appl. No.: 15/121,625

(22) PCT Filed: Dec. 17, 2014

(86) PCT No.: PCT/EP2014/078286

§ 371 (c)(1),
(2) Date: Aug. 25, 2016

(87) PCT Pub. No.: WO2015/128024

PCT Pub. Date: Sep. 3, 2015

(65) Prior Publication Data

US 2016/0355367 A1 Dec. 8, 2016

(30) Foreign Application Priority Data

Feb. 27, 2014 (DE) ..... 10 2014 102 605

(51) Int. Cl.
*B65H 35/02* (2006.01)

(52) U.S. Cl.
CPC ... *B65H 35/02* (2013.01); *B65H 2301/41487* (2013.01); *B65H 2406/30* (2013.01)

(58) Field of Classification Search
CPC ..... B65H 35/02; B65H 2406/30; B65H 2301/41487
USPC ..... 15/415.1; D32/32
See application file for complete search history.

(56) References Cited

U.S. PATENT DOCUMENTS 5,194,062 A 3/1993 Membrino
5,322,232 A * 6/1994 Freeman ..... B08B 15/00 242/471
6,098,510 A * 8/2000 Hada ..... B26D 3/16 242/525.2

(Continued)

FOREIGN PATENT DOCUMENTS

DE 102006057453 A1 2/2008
EP 0733447 A2 9/1996

(Continued)

*Primary Examiner* — Marc Carlson
(74) *Attorney, Agent, or Firm* — Bret E. Field; Bozicevic, Field & Francis LLP

(57) ABSTRACT

The present invention relates to a Suction nozzle (110) for a suction device (100) for conveyance of cut waste strips (210) of a film web (200) comprising a nozzle duct (10) with a nozzle inlet (12) for suctioning the waste strips (210) and with a nozzle outlet (14) for introducing the waste strips (210) into the suction duct (130), wherein the nozzle duct (10) comprises an inlet portion (12*a*) adjacent to the nozzle inlet (12) and an outlet portion (14*a*) adjacent to the nozzle outlet (14) and between the outlet portion (14*a*) and the inlet portion (12*a*) an at least one rotation portion (16*a*) is assembled, whose flow cross section (20) is at least partially twisted over the run of the rotation portion (16*a*).

13 Claims, 6 Drawing Sheets

(56) References Cited

U.S. PATENT DOCUMENTS

Figure 2:
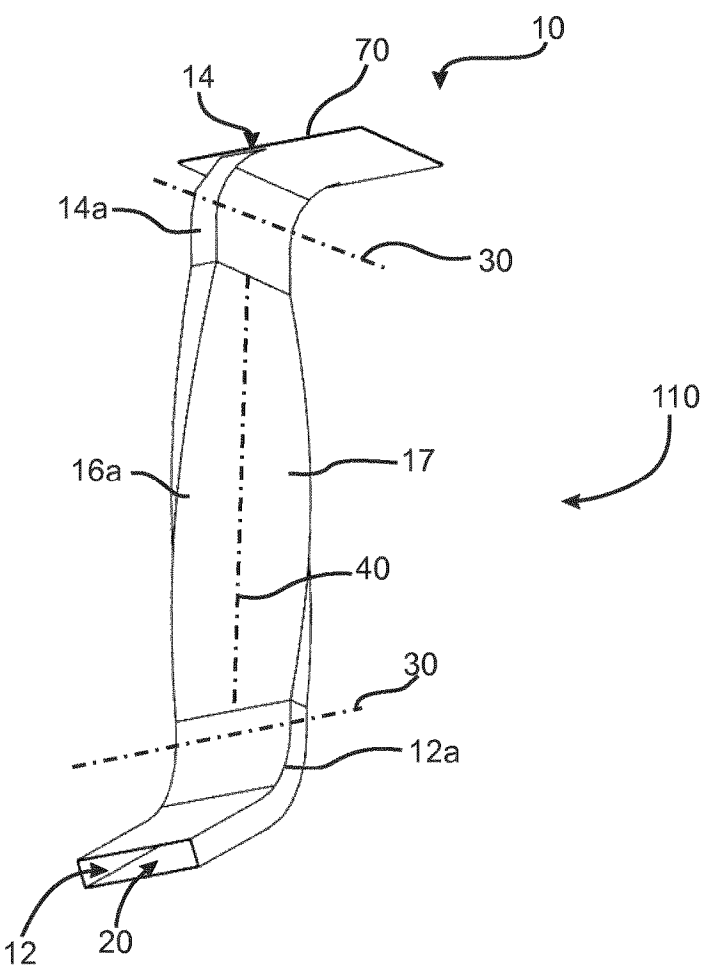

| | | | | |
|---|---|---|---|---|
| 6,983,757 | B1 * | 1/2006 | Becker | B08B 15/002 137/14 |
| 9,896,294 | B2 * | 2/2018 | Ing | B65H 29/243 |
| 2004/0143931 | A1 * | 7/2004 | Dennis | A47L 5/14 15/414 |
| 2010/0170060 | A1 * | 7/2010 | Eccardt | A47L 5/36 15/415.1 |
| 2012/0202671 | A1 * | 8/2012 | Haupt-Terlau | B65H 35/02 493/419 |
| 2016/0362271 | A1 * | 12/2016 | Sundermann | B65H 35/02 |

FOREIGN PATENT DOCUMENTS

| | | | |
|---|---|---|---|
| EP | 1334936 | A1 | 8/2003 |
| JP | H1053362 | A | 2/1998 |

* cited by examiner

SUCTION NOZZLE FOR A SUCTION DEVICE

The present invention relates to a suction nozzle for a suction device for a cut waste strip of a film web and a corresponding suction device.

It is basically known that with the production of film webs these subsequently have to be cut to achieve exact measuring. This cut occurs at least laterally such that at each edge of the produced film web an edge strip results as a waste strip. Likewise, a central cut of the film web can be performed such that one or multiple central strips can result as waste strips. In the production machine a removal and separation of these waste strips from the film web have to be performed after cutting.

For the removal of the waste strips different suction solutions are known, wherein for example reference DE 10 2012 108 109 shows a corresponding solution. Thereby, a waste strip is sucked into the suction device via single suction nozzles, respectively. For the transfer nozzle outlets are provided at the other edge of the suction nozzle, which provide an introduction of the waste strips in a common suction duct. With other words for each waste strip or each position of a waste strip a separate suction nozzle is intended in order to be able to perform a corresponding conveyance. Disadvantageously with the known solution is the necessary geometric configuration of the suction nozzle. Thus, the suction duct proceeds transversely to the conveyance direction of the film web. A waste strip, which is cut along the conveyance direction of the film web and correspondingly is sucked into the suction nozzle proceeds accordingly transversely to the conveyance direction of the film web within the suction duct. Between these both directions of the waste strips the suction nozzle is located such that within the suction nozzle an alteration of the orientation of the waste strip has to occur. This alteration of the orientation occurs in the angle, which exists between the conveyance direction of the film web and the orientation of the suction duct. In order to ensure this the waste strip has to perform a corresponding variation movement within the suction nozzle. Thus, a flat waste strip rotates within the suction nozzle and is transferred in the rotated or twisted position in the suction duct. In order to enable this turn of the waste strip during the conveyance a sufficiently great cross section of the suction nozzle has to be provided. Normally, this is a rectangular cross section or a round cross section, which can ensure the necessary freedom for the turning of the waste strip in all orientations during the conveyance in the suction nozzle. This limitation to round or squared cross sections leads to the fact that a relatively high material effort and a high space effort is necessary for the suction nozzle. A further disadvantage is the necessary great blower stream and therewith the necessary higher blower performance resulting from the great blow cross section.

It is the object of the present invention to at least partially avoid the described disadvantages. Particularly it is the object of the present invention to provide an improved suction nozzle in a cost efficient and simple manner, which particularly comprises a lower weight and/or a lower space requirement. Preferably, a smaller volume stream in the suction nozzle and/or a smaller noise generation should be achieved.

The previous object is solved by a suction nozzle and a suction device as described herein. Further features and details of the invention result from the dependent claims, the description and the drawings. Thereby, features and details, which are described in connection with the suction nozzle according to the invention naturally also apply in connection with the suction device according to the invention and vice versa such that according to the disclosure of the single aspects of the invention it can always be reciprocally related to.

A suction nozzle according to the invention for a suction device for conveying of cut waste strips of a film web comprises a nozzle duct. This nozzle duct is configured with a suction inlet for sucking the waste strips and a suction outlet for introducing the waste strips in the suction duct. Thereby, the nozzle duct comprises an inlet portion adjacent to the nozzle inlet and an outlet portion adjacent to the nozzle outlet. Between the outlet portion and the inlet portion at least one rotation portion is assembled whose flow cross section is at least partially twisted over the course of the rotation portion.

With other words the inlet portion, the outlet portion and the rotation portion together configure preferably the complete nozzle duct. The nozzle duct is configured by walls such that an inside of the duct is separated from the duct surrounding. The duct channel is particularly configured fluid-tight such that a nozzle duct of this embodiment can transmit a negative pressure from the nozzle outlet to the nozzle inlet. This suction conveyance using negative pressure can therewith be ensured via a suction nozzle.

Naturally, it is possible that two or more rotation portions are intended. Further, partially a straight extension between two or more rotation portions can be intended in case it is required by the space requirement in the machine.

The inlet portion and the corresponding nozzle inlet serve for the fact to receive the waste strip at or in the vicinity of the position of the cutters of the waste strip from the film web. This receipt occurs by a suctioning by a negative pressure. This negative pressure is produced on the opposite side, namely at the nozzle outlet and for example produced by a blower, existing in the suction device.

If now with the suction nozzle according to the invention a suction of a waste strip occurs, the following part is covered. Via the applied negative pressure at the nozzle inlet a suction of the waste strip occurs such that the waste strip reaches the nozzle duct. After entering the nozzle inlet the waste strip proceeds through an inlet portion in the rotation portion. In the rotation portion now the already described and necessary turning of the waste strips to the corresponding angle orientation of the suction duct occurs with relation to the conveyance direction of the film web. The turning is enabled by a corresponding turning of the flow cross section via the rotation portion. After the turning, the outlet portion and correspondingly the nozzle outlet follows such that the twisted part of the waste strip can now enter into the subsequent suction duct of the suction device in the correct orientation.

Like it is expressed in the previous paragraph the rotation or the turning of the waste strip occurs in correlation with the turning of the flow cross section of the rotation portion. Therewith the rotation portion can be understood in a way that additionally to the enabling of this turning it also represents a guidance for this turning. An undesired overturning during turning of the waste strip can be ensured by this guidance functionality of the rotation portion with a higher security.

Due to the fact that the rotation portion with its twisted flow cross section simulates the necessary turning or even guides the necessary turning, the whole flow cross section of the suction nozzle can be configured even more flat. The film web normally comprises only a small thickness in contrast to the width such that the flow cross section of the suction nozzle can for example be configured rectangular. This rectangle with a width, which is oriented particularly at the maximum width of the cut waste strip, is clearly more distinctive than the corresponding height. Thus, it is sufficient when a corresponding flat rectangular flow cross section is intended since for the necessary turning of the waste strip this flat rectangular flow cross section is twisted by itself in the rotation portion. Like it can be recognized from the previous description in this manner a significantly more compact and smaller and correspondingly even lighter and material saving embodiment of the suction nozzle can be provided, which moreover enables a smaller airstream. This leads to cost savings and to compact solutions at the corresponding production facility and the reduced air stream to energy savings.

It has to be pointed out that for the flow cross section naturally also variations via the course of the suction nozzle are possible. This is however an advantage when over the whole course the flow cross section for the suction nozzle and the whole nozzle duct is constant or even or mainly even. The orientation of the nozzle inlet and the nozzle outlet in the corresponding inlet portion and the corresponding outlet portion can be mainly freely chosen. The turning within the rotation portion can be configured ridged or variable and correspondingly adjustable.

According to the invention the term turning or rotating is explicit. Thus, a turning of the waste strip occurs when it turns about or mainly about its conveyance axis. With a flat band in form of a waste strip it means that its cross section turns or rotates about its main focus point. Accordingly, also a turning or rotation of the flow cross section applies for the rotation portion. Particularly, the turning or the rotating of the waste strip and the rotation portion has to be differentiated from a bending with a course of an arch. During the rotation or turning within the sense of the present invention a turning about its own axis of rotation, for example along the conveyance direction, means a bending occurs about a bending axis spaced apart from the own position and from another orientation.

The single aspects, particularly the inlet portion, the outlet portion and the rotation portion, can comprise different flow cross sections within the scope of the present invention. Thus, for example between a rectangular inlet portion and a rectangular outlet portion also a round rotation portion can be assembled. In this way the rotation portion creates an alteration of the orientation of the film strip.

It can be an advantage when with the suction nozzle according to the invention the nozzle duct comprises a constant or mainly constant flow cross section between the nozzle inlet and the nozzle outlet. Particularly, thereby it comprises one of the following geometric forms:

Rectangular
Oval
Ellipsis
Triangle

The previous enumeration is a non-final list. It is pointed out that only by the configuration of the rotation portion according to the invention at the suction duct a free or mainly free choice of the flow cross section is enabled. This is based on the fact that the necessary freedom of turning for the waste strip is provided by the rotation portion and its orientation or its twisted orientation. Only by this the existing freedom concerning the geometric choice of the flow cross section occurs. Preferably, the flow cross section is chosen with a corresponding adjustment at the to be expected geometric measures of the waste strip. Accordingly, an oval configuration or a rectangular configuration with a great width and a small height is an advantage concerning space requirements, streaming relations and weight and a small volume stream.

Another advantage can be achieved when with the suction nozzle according to the invention the rotation portion is at least partially configured flexible for variation of the shape of the turning of the flow cross section via the course of the rotation portion. This ensures an adjustment to the necessary turning of the respective purpose. For example according to the produced film web or the orientation of the production machine a different angular position of the suction duct to the conveyance direction of the film web can be available. Often, this position is chosen in the area of about 90°, however, naturally basically also other orientations are possible. Is the rotation portion at least portion-wise configured flexible, the degree of the turning in form of a turning angle can be adjusted to the respective actual angle of attack between the suction duct and the conveyance direction of the film web by variation and the flexible and even elastic deformation of the rotation portion. One possibility of such a flexible configuration is for example a flexible piping with corresponding flat cross section like previously described.

It is likewise an advantage when with the suction nozzle according to the invention the rotation portion comprises a turning of the flow cross section in an angle of approx. 45° to approx. 135°, particularly in an area between approx. 80° and approx. 100°, preferably an area between approx. 88 and approx. 92°. Like already described for the necessary turning it is crucial how big the angle of attack between an extending suction duct and the conveyance direction of the film web is configured. Particularly, thereby a suction duct is configured possibly short such that preferably a mainly perpendicular orientation of the suction duct to the conveyance direction of the film web results. This angle of attack is crucial for the configuration of the necessary turning angle in the rotation portion. Accordingly, it is preferred to provide a perpendicular or mainly perpendicular orientation with this rotation such that as a turning angle approx. 88° to approximately 92° comprises great advantages.

A further advantage can be achieved when with the suction nozzle according to the invention an inlet portion and/or an outlet portion comprises a bended course of the flow cross section. Thereby, this bended course of the inlet portion and/or the outlet portion comprises a bending axis. This bending axis is particularly adjusted perpendicularly or mainly perpendicularly to the turning axis of the turning of the flow cross section in the course of the rotation portion. Like already described within the sense of the present invention it has to be differentiated between a turning about an own axis of rotation and a bending about a spaced apart bending axis. With a suction nozzle by the configuration of bendings in the inlet portion and in the outlet portion a corresponding interface orientation can be created. In this manner a flat and a correspondingly streaming optimized introduction of the waste strip from the nozzle outlet in a subsequent suction duct can occur. By a corresponding bending at the inlet it is ensured that an easier threading and particularly kink-free introduction of the waste strip in the nozzle inlet is enabled. Likewise, an improved adjustment or mounting possibility to a suction device at the nozzle inlet can be ensured in this manner. The perpendicular orientation leads to a further improved configuration, respectively particularly in a fluidic point of view. Naturally within the scope of the present invention also a straight inlet portion and also a straight outlet portion can be used.

It is likewise an advantage when with the suction nozzle the inlet portion comprises a mounting interface for the assembly of a suction device. According to the invention the suction itself can be interpreted by the production of a negative pressure at the nozzle inlet. However, according to the production machine an active support of the suction can be provided, such for example niprolls can be intended, which establish a corresponding tension situation within the film web or within the waste strip, particularly via mechanical installations. Such a suction device can be assembled or mounted at a corresponding mounting interface of the inlet portion. This enables parallelly or alternatively to a manual threading in the nozzle inlet an automatization of the start process during the production of the film web.

It can further be an advantage when with the suction nozzle according to the invention the outlet portion and/or the nozzle outlet comprises a bearing device for example in form of a guidance device for a movable bearing, for example in form of a guidance, of the suction nozzle and the suction duct of the suction device. Thereby, a variation of different positions of the suction nozzle for different positions of the waste strip has to be understood. This bearing device is particularly sealed against pressure loss such that despite of the displaceability a fluid-tightness or mainly fluid-tightness occurs. The suction duct is accordingly configured as a counter-bearing device in order to receive or movably bear one or multiple suction nozzles. If, for example, in a production machine different film widths for the film web are possible, an adjustment of the single positions of the suction nozzle to the respective alterable position in dependence of the existing film width can occur by the displaceable bearing and preferably by sealing of the suction nozzle.

It is likewise an advantage when with the suction nozzle according to the invention the width of the flow cross section at the nozzle inlet is greater or even to the maximum width of the waste strip of the film web. This means that the maximum waste strips specify the corresponding maximum dimension of the suction nozzle. Particularly, this aims to a corresponding wide rectangular flow cross section with very flat height. The height of the flow cross section orientates thereby not only at the maximum height of the film web but also at the importability of the waste strip into the corresponding nozzle inlet.

It is further an advantage when with the suction nozzle according to the invention the rotation portion comprises wall surfaces, which comprise area portions, particularly rectangular area portions for the configuration of the turning of the flow cross section over the course of the rotation portion. The area portions are particularly flat area portions. This leads to the fact that by the assembly of single even or correspondingly easy to produce areas a complex turning is provided. The use of rectangular, even area portions leads to a particular simple and cost efficient configuration of the turning. While alternatively flexible materials have possibly to be used, by such a configuration also by plastic deformations the corresponding turning in the rotation portion can be provided. Thus, here, similar to air channels, corresponding area portions can simulate a twisted course of the rotation portion. Naturally alternatively to the rectangular area portions also other area portions, for example rectangular or trapeze-like or parallelogram-like area portions, are possible in the scope of the present invention. By alternative production methods, for example the use of composite materials like GFK or CFK, a continuous bended area can be provided.

Likewise, a suction device for suction and conveyance of the cut waste strips of a film web is subject matter of the present invention. This suction device comprises a suction duct, at least a suction nozzle according to the invention, which is at its nozzle outlet connected to the suction duct in a fluid communicating manner and at least one blower. The blower is configured for the generation of an air stream within the suction duct and the at least one suction nozzle. By the use of a suction nozzle according to the invention a suction device according to the invention comprises the same advantages like they are already described in detail in relation to the suction nozzle according to the invention. The blower can separately or in itself comprise additional functions, particularly a chopping function. Thus, the single blower sheets can be configured with corresponding cutting in order to be able to perform a re-granulating after the conveyance of the waste strips.

Figure 1:
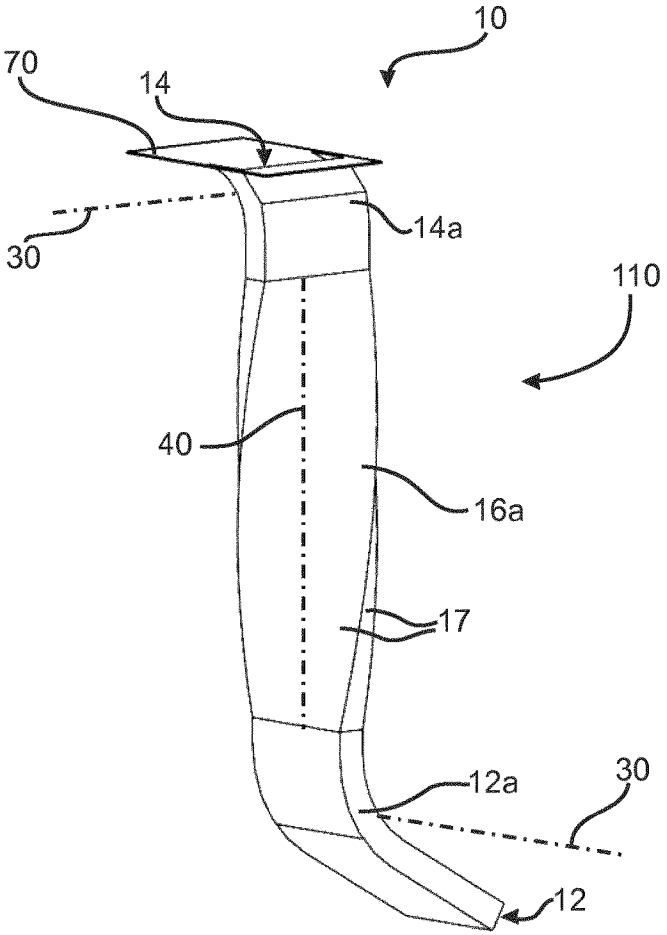
Figure 3:
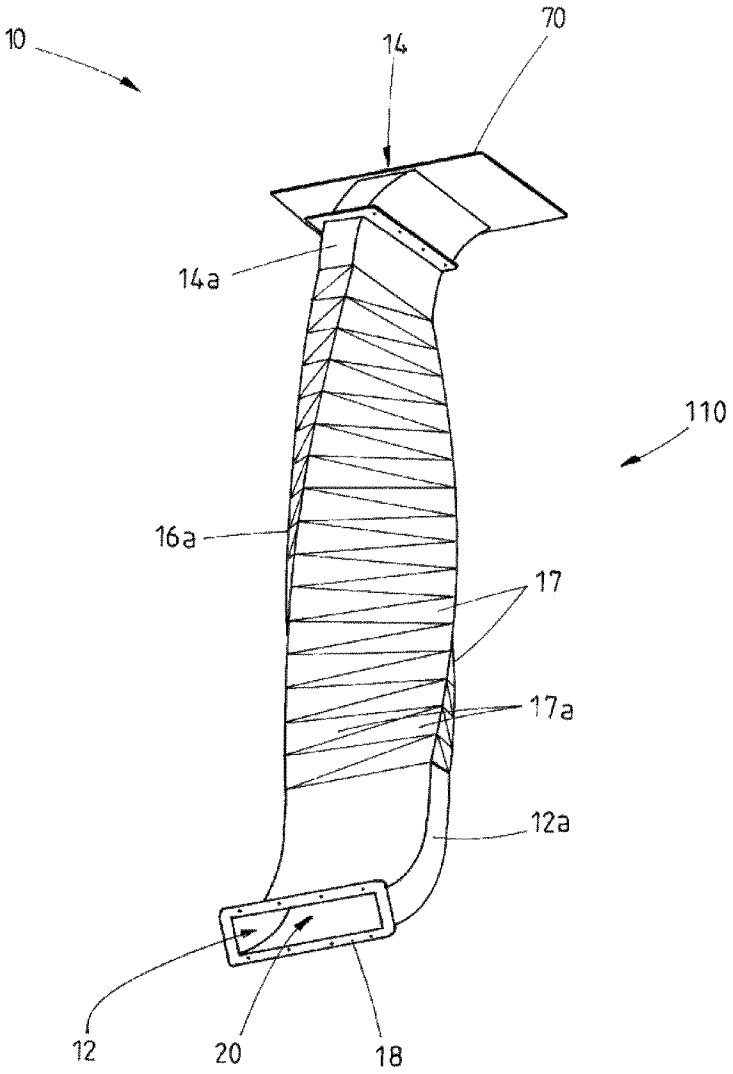
Figure 4:
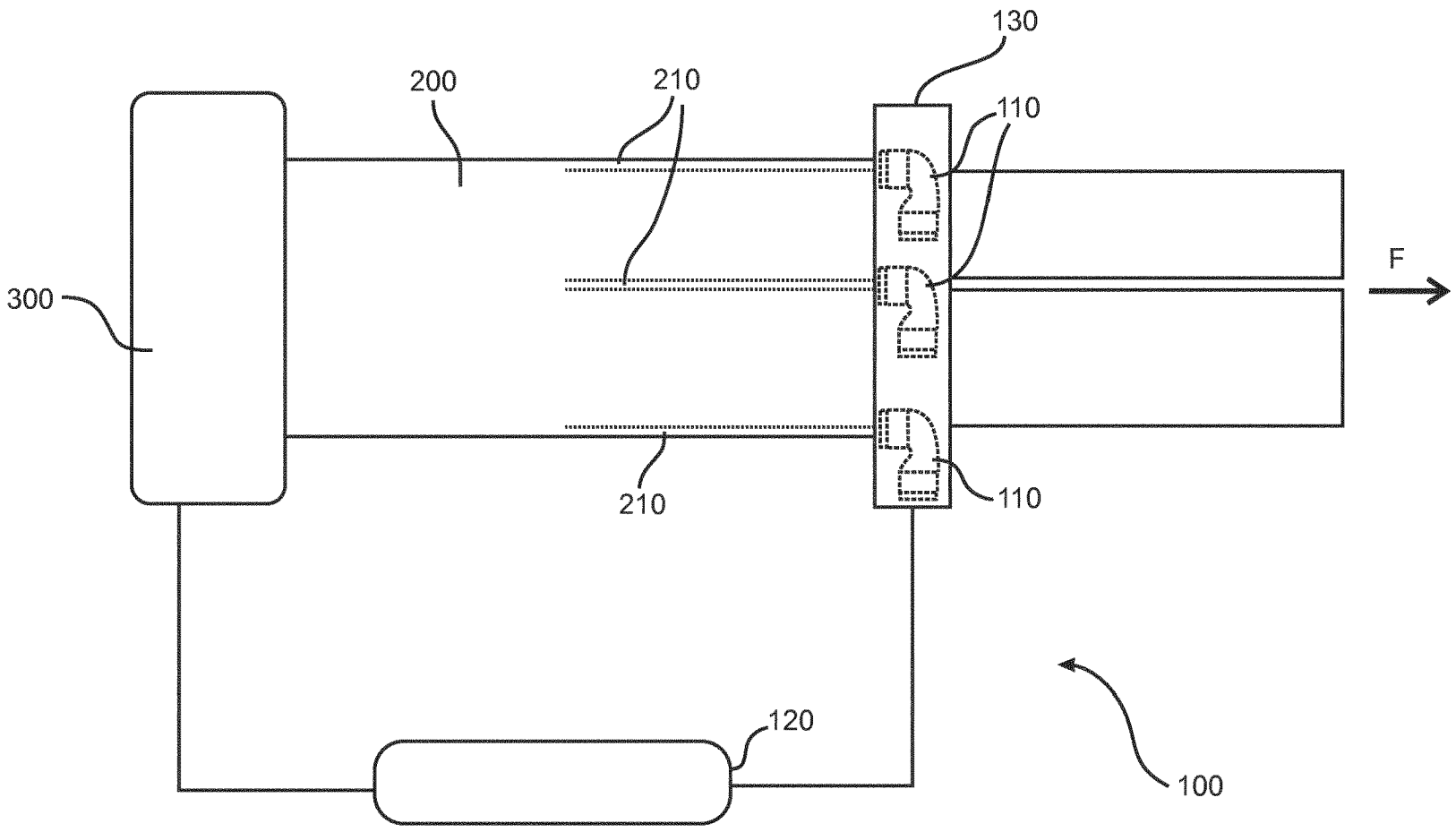
Figure 6:
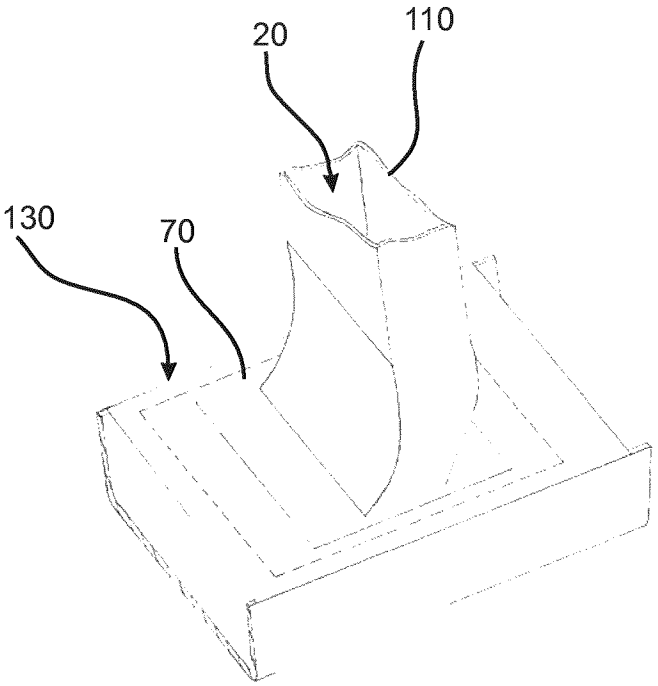
Figure 5:
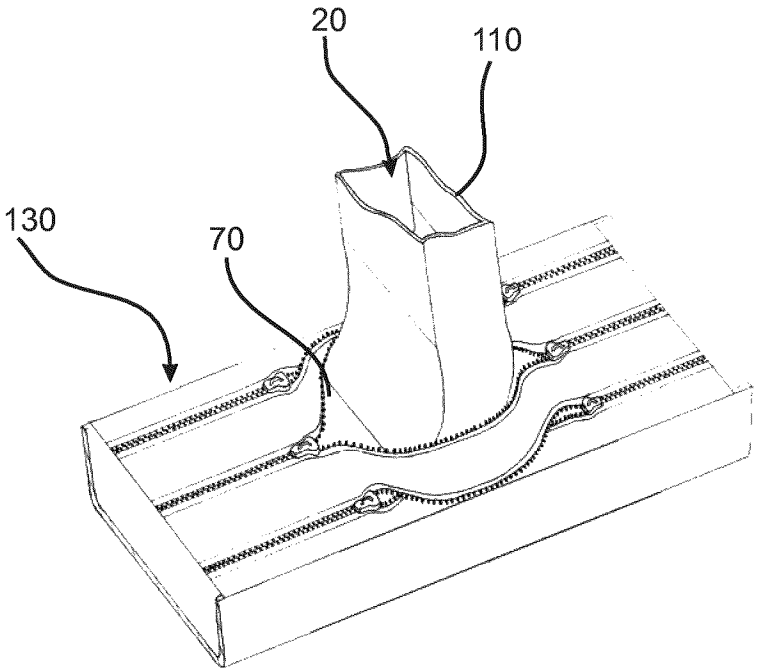
Figure 8:
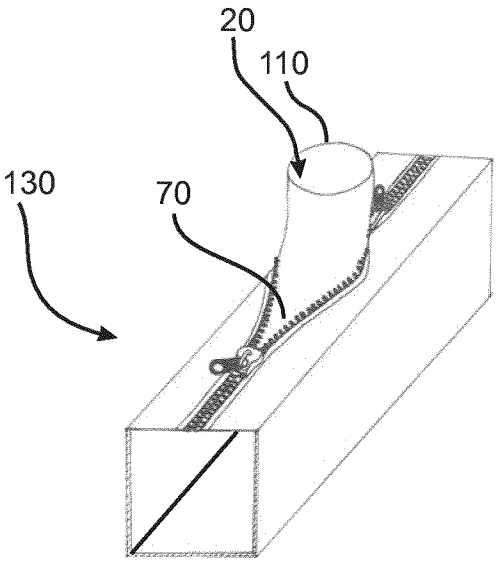
Figure 7:
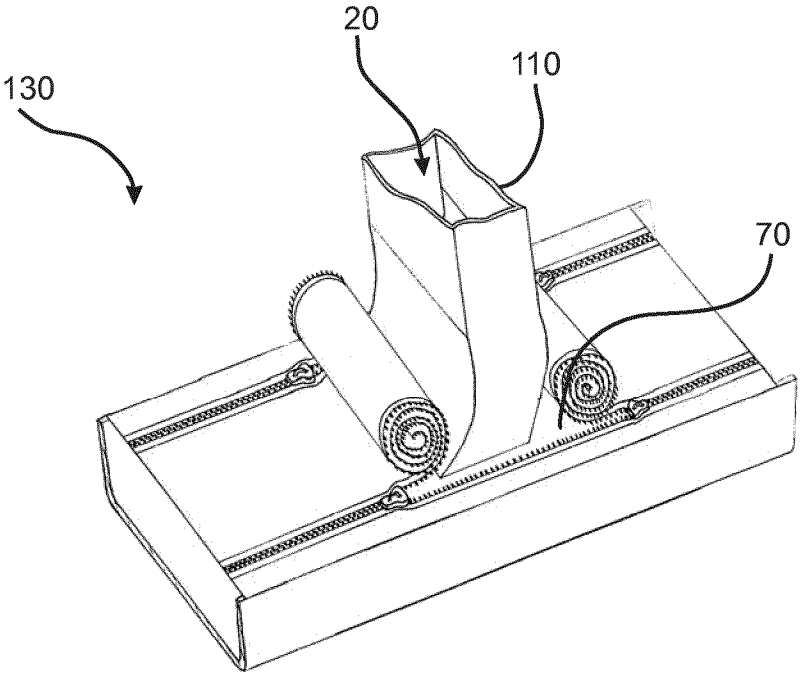

Further advantages, features and details of the invention result from the subsequent description in which in relation to the drawings embodiments of the invention are described in detail. Thereby, the features described in the claims and in the description can be essential for the invention each single for themselves or in any combination. It is shown:

FIG. 1 a first embodiment of a suction nozzle according to the invention,

FIG. 2 an embodiment of FIG. 1 in another perspective representation,

FIG. 3 a further embodiment of a suction nozzle according to the invention,

FIG. 4 an embodiment of a suction device according to the invention,

FIG. 5 an embodiment of a bearing device according to the invention,

FIG. 6 a further embodiment of a bearing device,

FIG. 7 a further embodiment of a bearing device,

FIG. 8 a further embodiment of a bearing device and

Figure 9:
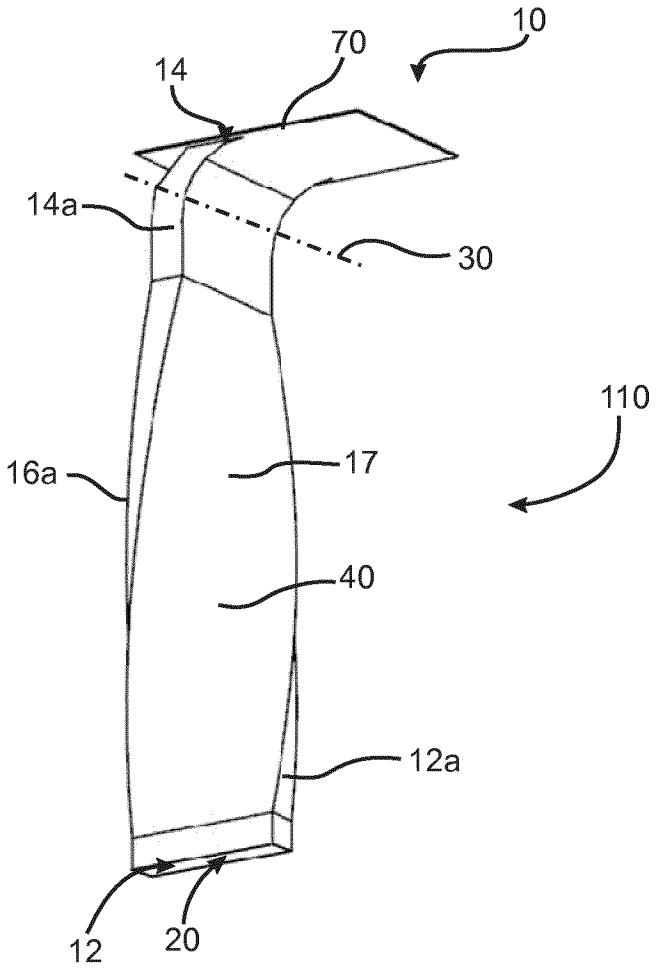

FIG. 9 a further embodiment of a suction nozzle according to the invention.

In FIGS. 1 and 2 a first embodiment of a suction nozzle 110 according to the invention is shown. This is configured with a nozzle duct 10, which extends from the upper side to the lower side. At the upper edge here the nozzle outlet 14 is shown, which represents the edge of the neighboring outlet portion 14*a*. The lower edge of the suction duct 130 is shown for the nozzle duct 10 with a nozzle inlet 12 and adjacent with an inlet portion 12*a*. Between the inlet portion 12*a* and the outlet portion 14*a* a rotation portion 16*a* is extending.

In the embodiment of FIG. 1 and FIG. 2 different bendings and a turning are shown. Thus, the inlet portion 12*a* and the outlet portion 14*a* are bended about a bending axis 30, respectively. The outlet portion 14*a* thereby proceeds preferably about a bending of up to approx. 90°. This bending is particularly dependent from the respective spatial situation and can be configured differently or may not be existent according to the coiling device. The inlet portion comprises a bending of approx. 30° to 40° about the bending axis 30. The rotation portion 16*a* is configured twisted concerning the flow cross section 20 about a turning axis 40. The turning angle about the turning axis 40 is approx. 90°.

Based on the bending of FIG. 1 and FIG. 2 a waste strip 210 can be sucked into the nozzle inlet 12 now. Via the bended course of the inlet portion 12*a* a bended conveyance of the waste strip 210*a* in the rotation portion 16*a* occurs. There a straight conveyance occurs during a turning of the waste strip 210 about the axis 40. After the termination of this turning process a further bended conveyance about the bending axis 30 of the outlet portion 14*a* can occur in order to finally introduce the waste strip 210 via the nozzle outlet 14 in a corresponding suction duct 130 assembled at the bearing device 70.

FIG. 3 shows the embodiment of FIG. 1 and FIG. 2 with a modification of the nozzle inlet 12. Thus, here a mounting interface 18 is shown at which a corresponding suction device can be assembled, which actively supports the suction of the waste strip 210. Here, the mounting interface 18 is a flange system, which can ensure this assembly by a corresponding screw connection.

Likewise, FIG. 9 shows a modification of the embodiments of FIGS. 1 and 2. Here it can be recognized that a straight outlet portion 12*a* is possible without any bending within the scope of the present invention. The further functions correspond to the embodiments of FIGS. 1 to 3.

FIG. 4 shows schematically an embodiment of a suction device 100 according to the invention. Based on a production machine 300 a film web 200 is produced by an extrusion process. Starting at a certain position a cutting occurs, which is shown by a dotted line. Through this cutting waste strips 210 result, like in this case two edge strips and one central strip. In order to remove these waste strips 210 from the film web such that the film web subsequently can be conveyed in conveyance direction F itself in the single film web portions, here the suction device 100 is intended. Via a blower 120 a negative pressure is produced at the suction duct 130. The suction duct 130 is in a fluid communicating connection with the suction nozzle 110 of the embodiment of FIGS. 1 to 3 for each waste strip 210. Thus with this embodiment a number of three suction nozzles 110 is intended. Schematically here also a turning and a bending is shown. Thus the suction of all waste strips 210 can occur at the respective position and by the combination from bending and turning can be transferred to a common transverse orientation of the suction duct 130. Therewith, adjacent to the suction duct 130 via a single line a plurality of here three waste strips 210 can be conveyed to the blower 120. Likewise it is shown that after the entry through the blower 110 and particularly after the re-granulating of the waste strip 210 a return of this re-granulate in the production machine 300 is possible.

In FIG. 5 a possibility of a displaceable bearing device 70 is shown, which here also acts as a sealing device for the suction nozzle 110 with the help of multiple zippers. FIG. 6 shows an alternative solution for the bearing device 70, wherein here a displaceable sealing plate against a film cover as a bearing device 70 is provided. FIG. 7 likewise shows a solution of the bearing device 70 wherein here the sealing is ensured via a zipper system. FIG. 8 likewise shows a zipper system for the bearing device 70, wherein here one single zipper is sufficient.

The previous description of the embodiments describes the present invention only within the scope of examples. Naturally, single features of the embodiments as far as technically meaningful can be freely combined with one another without leaving the scope of the present invention.

REFERENCE LIST

10 Nozzle duct
12 Nozzle inlet
12*a* Inlet portion
14 Nozzle outlet
14*a* Outlet portion
16*a* Rotation portion
17 Wall surface
17*a* Area portion
18 Mounting interface
20 Flow cross section
30 Bending axis
40 Axis of rotation
70 Bearing device
100 Suction device
110 Suction nozzle
120 Blower
130 Suction duct
200 Film web
210 Waste strips
300 Production machine
F Conveyance direction

The invention claimed is:

1. A suction nozzle for a suction device for conveyance of cut waste strips of a film web comprising a nozzle duct with a nozzle inlet for suctioning the waste strips and with a nozzle outlet for introducing the waste strips into a suction duct, wherein the nozzle duct comprises an inlet portion adjacent to the nozzle inlet and an outlet portion adjacent to the nozzle outlet and between the outlet portion and the inlet portion an at least one rotation portion is assembled, whose flow cross section taken perpendicularly to a direction of a run of the rotation portion has a rectangular or triangular geometric form and is at least partially twisted over the run of the rotation portion, so that the flow cross section is rotated around the direction of the run of the rotation portion, wherein the nozzle inlet comprises a mounting interface and the outlet portion comprises a rectangular or triangular geometric form.

2. The suction nozzle according to claim 1,
wherein
the suction duct comprises a constant or a mainly constant flow cross section between the nozzle inlet and the nozzle outlet.

3. The suction nozzle according to claim 1,
wherein
the rotation portion is partially flexible for a variation of shape of the turning of the flow cross section via the course of the rotation portion.

4. The suction nozzle according to claim 1, wherein
the rotation portion comprises a twisting of a flow cross section with an angle area of approximately 45° to approximately 135°.

5. The suction nozzle according to claim 4, wherein
the rotation portion comprises a twisting of a flow cross section with an angle area of approximately 88° to approximately 100°.

6. The suction nozzle according to claim 4, wherein
the rotation portion comprises a twisting of a flow cross section with an angle area of approximately 88° to approximately 92°.

7. The suction nozzle according to claim 1,
wherein
at least the inlet portion or the outlet portion comprise a bended run of the flow cross section, wherein this bended run of at least the inlet portion or the outlet portion comprise a bending axis to the axis of rotation of the turning of the flow cross section in the course of the rotation portion.

8. The suction nozzle according to claim 7,
wherein
the bending axis is adjusted perpendicularly or mainly perpendicularly to the axis of rotation of the turning of the flow cross section in the course of the rotation portion.

9. The suction nozzle according to claim 1,
wherein
at least the outlet portion and/or the nozzle outlet comprises a bearing device for a movable bearing of the suction nozzle at a suction duct of the suction device.

10. The suction nozzle according to claim 1,
wherein
the width of the flow cross section at the nozzle inlet is greater or equal to the maximum width of the waste strip of the film web.

11. The suction nozzle according to claim 1,
wherein
the rotation portion comprises wall surfaces, which comprise area portions for the configuration of the twisting of the flow cross section via the course of the rotation portion.

12. The suction nozzle according to claim 11,
wherein
the rotation portion comprises the wall surfaces, which comprise triangular area portions.

13. A suction device for suction and conveyance of cut waste strips of a film web, comprising a suction duct, at least a suction nozzle for a suction device for conveyance of the cut waste strips of a film web comprising a nozzle duct with a nozzle inlet for suctioning the waste strips and with a nozzle outlet for introducing the waste strips into the suction duct, wherein the nozzle duct comprises an inlet portion adjacent to the nozzle inlet and an outlet portion adjacent to the nozzle outlet and between the outlet portion and the inlet portion an at least one rotation portion is assembled, whose flow cross section taken perpendicularly to a direction of a run of the rotation portion has a rectangular or triangular geometric form and is at least partially twisted over the run of the rotation portion, so that the flow cross section is rotated around the direction of the run of the rotation portion, wherein the nozzle outlet is fluid communicating connected to the suction duct, and at least a blower for the generation of an air stream within the suction duct and the at least one suction nozzle,
wherein the nozzle inlet comprises a mounting interface and the outlet portion comprises a rectangular or triangular geometric form.

* * * * *